United States Patent [19]

Karcher

[11] 3,976,107

[45] Aug. 24, 1976

[54] DEVICE FOR FLUID INSERTION OF THE FILLING THREAD ON A LOOM

[75] Inventor: Charles Karcher, Kusnacht, Switzerland

[73] Assignee: Ruti Machinery Works Ltd., Ruti, Zurich, Switzerland

[22] Filed: Apr. 1, 1975

[21] Appl. No.: 564,036

[30] Foreign Application Priority Data

Apr. 18, 1974 Switzerland ..... 5353/74

[52] U.S. Cl. ..... 139/435

[51] Int. Cl.[2] ..... D03D 47/32

[58] Field of Search ..... 139/127 P, 127 R; 222/309; 417/400

[56] References Cited

UNITED STATES PATENTS

| | | | |
|---|---|---|---|
| 2,796,085 | 6/1957 | Svaty et al. | 139/107 P |
| 3,149,753 | 9/1964 | Forsyth | 222/309 X |
| 3,759,424 | 9/1973 | Maddock | 222/309 |
| 3,782,422 | 1/1974 | Vermeulen | 139/127 P |

FOREIGN PATENTS OR APPLICATIONS

| | | | |
|---|---|---|---|
| 45-35388 | 11/1970 | Japan | 139/127 P |
| 45-35387 | 11/1970 | Japan | 139/127 P |

*Primary Examiner*—James Kee Chi
*Attorney, Agent, or Firm*—Donald D. Denton

[57] ABSTRACT

A device for improving fluid insertion of a filling thread on a loom, which device has a reciprocal pump for supplying fluid to a filling thread insertion nozzle with the plunger of the pump operatively connected to a driven cam through a spring biased transmission mechanism with means to vary the length of the stroke of the pump and the transmission mechanism being biased against the cam during the suction stroke.

7 Claims, 2 Drawing Figures

DEVICE FOR FLUID INSERTION OF THE FILLING THREAD ON A LOOM

BACKGROUND OF THE INVENTION

The present invention relates to a device for the insertion of the filling thread by means of a jet of fluid on a loom. The device comprises a reciprocating pump for the drawing in of fluid and the pumping out of said fluid into a filling thread insertion nozzle, a spring operatively connected with the piston of the reciprocating pump to produce the discharge stroke of the piston, a driven cam, a feeler roller operatively cooperating with said cam and a transmission mechanism between the feeler roller and the piston of the reciprocating pump in order to bring about the suction stroke of the piston in opposition to the action of the spring.

In such a device it is necessary that the quantity of fluid pumped by the discharge stroke of the piston of the reciprocating pump be correctly dimensioned for each filling thread insertion in accordance with the textile requirements, such as, type of filling thread material, width of loom, operating speed, and the like. The amount of fluid delivered per discharge stroke must therefore be capable of being changed. Replacement of the cam or the reciprocating pump or its pistons would be too difficult and time consuming. It is therefore already known to change the amount of fluid pumped per discharge stroke by providing an adjustable stop in order to limit the discharge stroke of the reciprocating pump which takes place under the action of the spring. In this way the result is obtained that upon each discharge stroke a part of the content of the pump which lies between zero and the maximum displacement of the pump has been delivered. This type of regulation of the delivery, however, has a number of disadvantages, namely:

The stop which shortens the length of the stroke has the result that the feeler roller, each time that it strikes the stop, periodically lifts itself off of the cam and the cam subsequently comes against the lifted feeler roller, whereby an undesired amount of noise and excessive wear of the feeler roller and of the cam are caused. Since the suction stoke of the reciprocating pump is caused, depending on the adjustment of the stop, by means of a longer or shorter portion of the ascending part of the cam, the duration of the suction stroke, in case of constant speed of rotation of the cam, is dependent on the adjustment of the stop. As long as the feeler roller has been lifted by the stop from the cam, the reciprocating pump remains at rest, and this period of time is not utilized for the operation of the pump nor drawing in of fluid. As soon as the cam comes against the raised feeler roller, the suction stroke is directly commenced whereby a vacuum is produced in the pump chamber since the fluid cannot flow sufficiently rapidly into the pump. The formation of this vacuum leads to undesired eddying on the part of the inward flowing fluid, and, if the fluid is a liquid, to partial evaporation of the liquid and thus to the production of gases in the pump chamber. In neither case does the volume of fluid drawin into the pump correspond precisely to the volume of the pump chamber. Upon the following discharge stroke of the piston therefore, instead of the desired quantity of fluid being discharged, there is discharged a smaller quantity which varies in indefinite manner so that the insertion of the filling thread takes place in nonuniform fashion and in some cases even defectively.

SUMMARY OF THE INVENTION

The object of the present invention is to provide a device of the aforementioned type in such a manner that the disadvantages described are avoided. The solution for this problem which has been found is characterized primarily by the fact that, in order to change the stroke of the piston of the reciprocating pump, the transmission mechanism between the feeler roller cooperating with the cam and the piston has a swingable lever with variably adjustable lever transmission ratio and that during the suction stroke and independently of the length of stoke set the feeler roller, under the influence of the spring, lies against the face of the cam along the entire ascending portion of the cam.

With this development the entire length of the control curve of the cam is constantly utilized for the movement of the feeler and thus of the piston of the reciprocating pump. In this way one avoids having the feeler roller periodically lifted off from the face of the cam and then being abruptly again brought into engagement with it, as a result of which noise and wear are reduced. Furthermore, the duration of the suction stroke remains constant, in contradistinction to the known embodiment, regardless of the length of stoke set for the piston provided that the speed of rotation of the cam is not changed. It is of utmost importance however that, upon each adjustment of the length of the piston stroke, the initial phase of the suction stroke be capable of being controlled as a predetermined function of time by means of the cam so that the formation of a vacuum is avoided and the fluid in each case flows as a solid stream into the pump chamber without injurious eddying or formation of vapor bubbles. Thus upon the following delivery stoke of the piston, the exact desired quantity of fluid is in each case expelled whereby a correct insertion of the filling thread is made possible.

In one particular development of the device in accordance with the invention it can be seen that, by the adjustment of the lever transmission ratio, the position of the piston of the reciprocating pump at the end of the suction stroke of the pump is variable, while the position of the piston at the end of the delivery stroke remains at least approximately the same. In this development the quantity of fluid present in the pump chamber is always the same at the start of the suction stroke, so that the same conditions are always present during the critical initial phase of the suction stroke regardless of the length of stroke established at the time. In this way there is obtained a further improvement in the functional relationship between the adjusted piston displacement and the volume of fluid discharged upon the discharge stroke.

BRIEF DESCRIPTION OF THE DRAWINGS

Further objects, features and details of suitable embodiments of the device in accordance with the invention will be seen from the following description and from the corresponding drawing in which the subject of the invention has been described and illustrated and in which.

DESCRIPTION OF PREFERRED EMBODIMENTS

Figure 1:
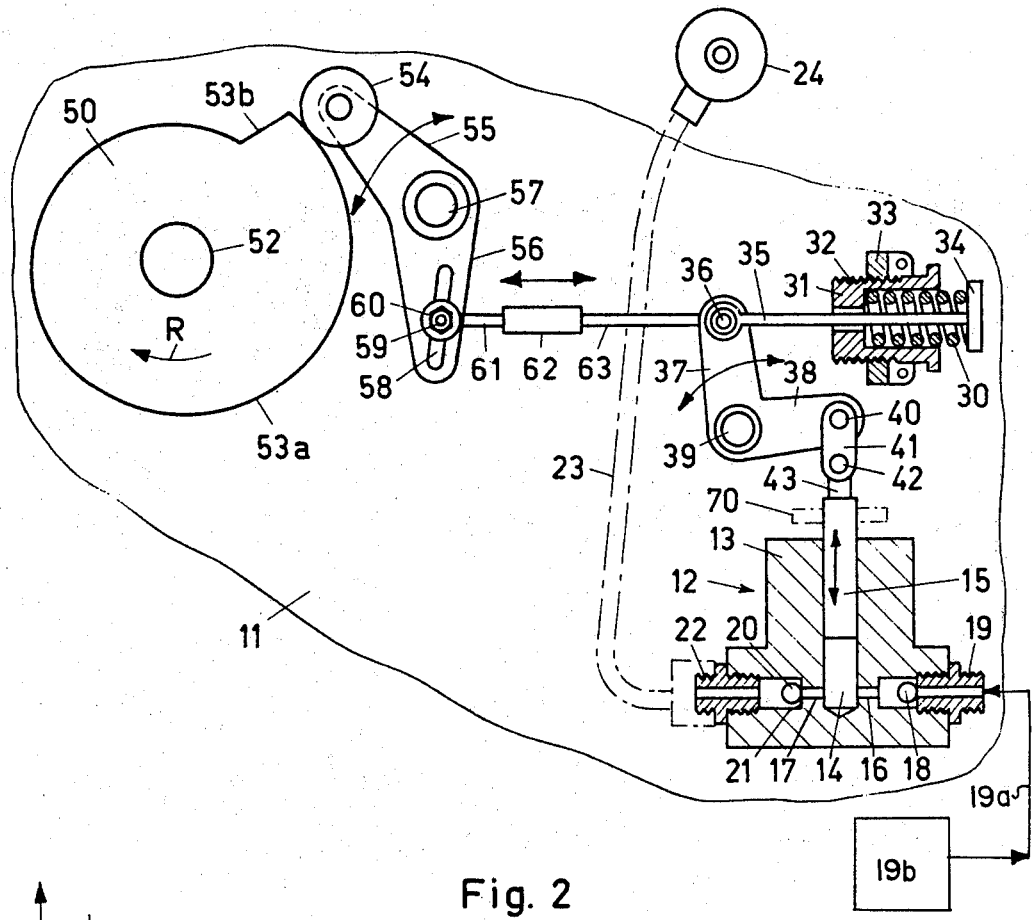
FIG. 1 is a side view partially in vertical cross-section showing a preferred embodiment of the device.

Referring to FIG. 1 of the drawings, on a side wall 11 of a loom there is fastened a reciprocating pump 12 which has a housing 13 with a cylinder bore 14 and a reciprocating piston 15 movable up and down in the bore 14. A fluid inlet bore 16 and a fluid outlet bore 17 are provided. Inlet bore 16 provides for the fluid ingress into bore 14 where it is pumped by the pump through outlet bore 17. It will be appreciated that the fluid may be water or air. Positioned in a widened portion of the inlet bore 16 is located a ball value 18 which forms a nonreturn valve in cooperation with the face of nipple 19. To the nipple 19 there can be connected a suction line 19*a* which leads to a storage container 19*b* for the fluid which is to be conveyed. A widened portion of the outlet bore 17 also contains a ball valve 20 which forms a nonreturn valve in cooperation with a shoulder 21 of the bore 17. The ball valves 18 and 20 can each have a spring (not shown) associated with it, the springs biasing the corresponding walls of the ball valves into a closed position. A threaded nipple 22 connected to bore 17 permits the connecting of a pipeline, hose line, or conduit 23 which leads to a filling thread insertion nozzle 24 of known construction, so that fluid under pressure can be delivered intermittently from the pump through the insertion nozzle and carry a filling thread into the shed of the loom.

In the driving mechanism of the piston 15 of the pump 12 there are provided biasing means or spring 30 and a cam 50, the two being connected by a system of levers and rods with the piston 15 in the manner described below. The spring 30 is arranged in a sleeve 31 which is adjustable by means of a thread 32 in a corresponding threaded bore hole of a supporting piece 33 fastened to the side wall 11 of the loom. The other end of the spring 30 rests against an inner shoulder of the sleeve 31 while the other end of the spring rests against a disk 34. The latter is located at one end of a rod 35 which passes axially through the sleeve 31 and the spring 30. The opposite end of the rod 35 is connected by a pivot pin 36 with one arm 37 of a double arm lever 37, 38 which is swingable around a fulcrum pin 39 which is fastened to the side wall 11 of the loom. To the other arm 38 of the lever 37, 38 there is pivoted, by means of a pin 40, a strap 41 which in turn is pivotably connected by another pin 42 with an extension 43 of the piston 15. The two arms of the lever 37, 38 are at right angles to each other so as to produce a conversion of the horizontal movement back and forth of the rod 35 into a vertical up and down movement of the piston 15.

Cam 50 is connected to a shaft 52 of the loom and makes one complete rotation for each insertion of a filling thread. The circumference of the cam 50 is developed as a control curve which has a gradually ascending portion 53*a* and an abrupt dropoff portion 53*b*. Against the periphery or face of the cam 50 there rests a feeler roller 54 which is rotatably supported on one arm 55 of a double armed lever 55, 56. The lever 55, 56 is pivoted by means of a fulcrum pin 57 on the side wall 11 of the loom. The other arm 56 of the lever 55, 56 has a slot 58 through which there extends a threaded pivot pin 59. The pin 59 can be adjusted with infinite variation along vertically directed slot 58 and be adjustably clamped fast to the lever arm 56 by a nut 60 in the position in which it has been set. By means of the pin 59 there is pivoted to the lever arm 56 one end of a connecting rod 61 which is connected coaxially by a socket 62 with a second rod 63. The second rod 63 is pivoted by the pivot pin 36 through the arm 37 of the lever 37, 38. The socket 62 serves for the axial adjustment of the rods 61 and 63 with respect to each other. For this purpose the end portions of the rods 61 and 63 which are provided with the socket 62 is provided with corresponding internal threads. By turning the socket 62 around the longitudinal axis of the rods 61 and 63, the rods can be adjusted with respect to each other. Thus it can be seen that numerals 36 to 43 and 55 to 63 define a transmission mechanism for the operation of the pump 15 as the feeler roller 54 follows the curvature of the face of the cam 50.

The manner of use and operation of the device described is as follows:

When the cam 50 rotates in the direction indicated by the arrow R in FIG. 1, the feeler roller 54 is moved radially away from the axis of cam shaft 52 by the ascending portion 53*a* of the periphery of the cam, the lever 55, 56 being swung in clockwise direction about fulcrum pin 57. The rods 61, 63 and 35 are thereby pulled to the left in FIG. 1 against the biasing action of the spring 30. This results in the swinging of the lever 37, 38 in counterclockwise direction about fulcrum pin 39 so that the piston 15 of the reciprocating pump 12 is lifted by means of the strap 41. As a result of the upward movement of the piston 15 in the housing 13, a vacuum is produced within the bore 14 of pump 12 so that the ball valve 20 is closed and ball valve 18 is opened and fluid is drawn into bore 14 through the inlet bore 16.

When the abruptly descending portion 53*b* of the circumference of the cam 50 passes under the feeler roller 54, the supporting action of the cam 50 on the feeler roller 54 terminates, whereupon the rods 35, 63 and 61 are moved to the right in FIG. 1 under the influence of the biasing means or spring 30. The lever 37, 38 is thereby swung in clockwise direction whereby the piston 15 of the pump 12 is forced downward by means of the strap 41. In this way a pressure is produced within the pump 12 so that the ball valve 18 is closed and the ball valve 20 is opened, and fluid is forced out of bore 14 of pump 12 through the outlet bore 17. The fluid which has been forced out passes through the hose line or conduit 23 to the filling thread insertion nozzle 24 from which the fluid emerges in the form of a narrow jet and thereby engages the filling thread passing through the nozzle 24 into the opened shed. During the downward movement of the piston 15, the lever 55, 56 is swung in counterclockwise direction in FIG. 1 as a result of which the feeler roller 54 approaches the axis of shaft 52 of the cam 50 until the piston 15 is again raised against the action of the spring 30 by means of the ascending portion 53*a* of the cam 50. The processes described are repeated cyclically for each rotation of the cam 50.

From FIG. 1 it can be seen that by adjusting the pivot pin 59 along the slot 58, the distance between the pivot pin 59 and the pivot axis 57 of the lever 55, 56 can be varied and the lever transmission ratio thereby changed with infinite variation in the transmission mechanism 55 to 63 and 36 to 43 between the feeler roller 54 and the piston 15. When the pivot pin 59 is clamped fast against the lower end of the slot 58 of FIG. 1, the largest possible stroke of the piston 15 is obtained. On the other hand, when the pivot pin 59 is clamped fast at a point lying closer to the pivot 57 of the lever 55, 56 the stroke of the piston 15 becomes smaller. The smallest possible stroke is obtained when the pivot pin 59 is clamped at the upper end of the slot 58 in FIG. 1. Regardless of the lever transmission ratio set, the feeler roller 54 rests against the face of the cam upon each suction stroke of the piston 15 along the entire ascending portion 53*a* of the cam.

Figure 2:
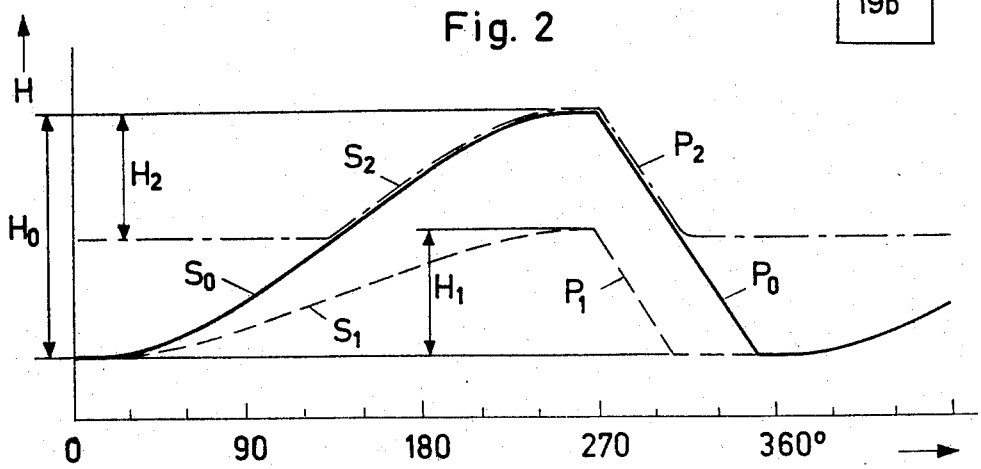
FIG. 2 is a graphical representation showing the stroke of the piston of the reciprocating pump as a function of the angle of rotation of a control cam during the functioning of the device.

Reference is now made to FIG. 2 which shows the movement of the piston 15 of the pump 12 as a function of the angle of rotation of the cam 50 for two different positions of the pivot pin 59 in the slot 58. The solid line shows the stroke of the piston 15 in the event that the pivot pin 59 is at the bottom end of the slot 58, whereby the greatest possible length of stroke $H_0$ is obtained (see FIG. 1). It can be seen that for the suction stroke $S_0$ an angle of rotation of the cam 50 of approximately 270° is necessary and that at the start of the suction stroke the piston 15 is gradually placed in motion out of its stopped position. In this way the vacuum is also gradually produced within the pump 12 so that the fluid which is drawn in has sufficient time to flow into the pump 12 whereby the production of a vacuum within the pump with all the disadvantages thereof is avoided. At the end of the suction stroke $S_0$ the movement of the piston 15 decreases gradually to a standstill, which again has a favorable effect on the flow of the fluid drawn in. The course of the delivery stroke $P_0$ is determined by the tension of the spring 30 and the resistance to flow which the fluid encounters upon being pushed out of the pump 12 and out of the filling thread insertion nozle 24. The tension of the spring 30 can be changed by axial displacement of the sleeve 31 by means of its thread 32 and adjusted as required. If the stroke of the piston 15 is reduced by setting the pivot pin 59, for instance, approximately in the center of the slot 58 as shown in FIG. 1, there is obtained the dashed line course of the movement of the piston shown in FIG. 2. For the suction stroke $S_1$ there is again required an angle of rotation of approximately 270° of the cam 50 for which reason, with the same speed of rotation of the cam 50, the duration of the suction stroke remains unchanged. The start and end of the suction stroke are again characterized by a gradual transition from standstill into movement and from movement into standstill position of the piston. Upon the drawing in of fluid therefore no injurious vacuum is produced within the pump 12 in this case either. The fluid can even flow more quietly into the pump than in the case of the greatest possible length of piston stroke since the same time is available for the drawing in of a smaller quantity of the fluid. After the maximum piston stroke $H_1$ has been reached the discharge stroke $P_1$ takes place which in its turn proceeds as a function of the tension of the spring 30 and of the resistance of flow upon the forcing of the fluid out of the pump.

It is seen that upon the shifting of the position of the pivot pin 59 the position of the piston 15 of the pump 12 at the end of the discharge stroke and at the beginning of the suction stroke remains substantially unchanged. For this purpose the slot 58 extends at least approximately tangentially to a circular arc around the pivot pin 36 or along the said arc when the feeler roller 54 rests against the peripheral point of smallest radius of the cam 50. In order to compensate for deviations in the starting position of the piston 15 the rods 61 and 63 are adjustable with respect to each other by means of the socket 62. As a result of the said constant position of the piston 15 after each discharge stroke regardless of whether a large or a small length of stroke of the piston has been set, there is at all times obtained approximately the same residual amount of liquid before each suction stroke of the piston so that the dynamic inward flow conditions for the fluid drawn in are always aubstantially unchanged.

Solely for purposes of comparison there has been also shown in dash-dot line in FIG. 2 the path of movement which the piston 15 would have if its stroke were, as was previously the case, reduced by the provision of a stop limiting the discharge stroke of the piston rather than by displacement of the pivot pin 59 as described above. Such a stop 70 could be arranged, as shown by way of example and in dot-dash lines in FIG. 1, on the part of the piston 15 extending out of the pump housing 13 so that by striking against the top of the housing 13 it prevents the further downward movement of the piston 15. From FIG. 2 it is clear that the stroke $H_2$ which is thereby obtained is, for instance, approximately equal in size to the above-described reduced stroke $H_1$ but that the development with time of the movement of the piston greatly differs from the case in which the length of the stroke is established by displacing the pivot pin 59. As shown by the dash-dot line in FIG. 2, the suction stroke $S_2$ takes place in a much shorter time and with higher speed than the suction stroke $S_1$. It is particularly disadvantageous that at the start of the suction stroke $S_2$ the movement of the piston commences practically instantaneously when the central part of the ascending portion 53*a* of the cam 50 travels against the feeler roller 54 which remained raised from the cam 50 after the stop 70 had come against the housing 13. The abrupt commencement of the suction stroke $S_2$ results in the formation of a vacuum within the pump 12 since the fluid drawn in cannot flow sufficiently rapidly into the pump as a result of which disturbing eddyings and, in the case of a liquid fluid, even vapor bubbles result. The resultant disadvantages have already been mentioned in the preamble. By the periodic striking of the central part of the ascending portion 53*a* of the cam 50 an unnecessary noise and an additional wear of the cam and of the feeler 54 also occur. When the stroke is limited by the stop 70 the residual quantity of fluid remaining within the pump at the end of each discharge stroke is finally also dependent on the length of stroke adjusted so that upon change of the length of stroke the dynamic flow conditions for the fluid drawn in are changed.

It is clear that the previously known manner of limiting the stroke by means of a stop, such as for instance as shown by numeral 70, has considerable disadvantages as compared with the change in the lever transmission ratio in accordance with the invention which has been described above.

In one embodiment (not shown) which is a variant to FIG. 1, a threaded spindle can be provided on the arm 56 of the lever 55, 56, and by means of it the distance of the pivot pin 59 from the pivot axis 57 of the lever 55, 56 can be varied in a convenient manner.

It will be appreciated that various changes and modifications may be made within the skill of the art without departing from the spirit and scope of the invention illustrated and described herein.

What is claimed is:

1. Device for fluid insertion of a filling thread on a loom, comprising a pump having a reciprocating piston for drawing in fluid and for delivering the fluid which has been drawn in from the pump to a filling thread insertion nozzle, a spring means operatively connected with the piston of the pump to produce the discharge stroke of the piston, a driven cam operatively connected to the drive mechanism of the loom, a feeler roller cooperating with the periphery of the cam and a transmission mechanism operatively connecting the feeler roller and the spring means to the piston of the pump to produce the suction stroke of the piston against the action of the spring means during the rotation of the cam, wherein in order to vary the length of stroke of the piston of the pump, the transmission mechanism has a pivotable lever with means to produce a variable adjustable lever transmission ratio and wherein, independently of the length of stoke set, the feeler roller during the suction stroke is biased against the cam along the entire ascending portion of the cam's periphery under the action of said spring means.

2. Device according to claim 1 in which, in the adjustment of the lever transmission ratio, the position of the piston of the reciprocating pump at the end of the suction stroke is varied, while the position of the piston at the end of the discharge stroke remains at least approximately the same.

3. Device according to claim 1 in which the pivoted lever is connected at one end by a pivot pin to a connecting rod which in turn is operatively connected to the pump, with the distance between the axis of the pivoted lever and the pivot pin being adjustable.

4. Device according to claim 3 in which the pivoted lever defines a slot through which there is positioned a pivot pin which is adjustable along the various positions of the slot to shorten or lengthen the arm and means to clamp fast the pin on the lever in the adjusted position.

5. Device according to claim 4 in which the slot extends at least approximately tangentially to a circular arc around the end of the connecting rod facing away from the lever.

6. Device according to claim 3 in which the lever is a double armed pivoted lever with the feeler roller being arranged on one arm of the lever and the pivot operatively connected to the connecting rod being operatively connected to the other arm.

7. Device according to claim 3 wherein said connecting rod comprises two rod sections arranged along a straight line and connected by a socket enabling a variation of the distance between the two rod sections.

* * * * *